US010758021B2

(12) United States Patent
MacKenzie

(10) Patent No.: US 10,758,021 B2
(45) Date of Patent: Sep. 1, 2020

(54) VOLUME ENHANCING HAIR DEVICE

(71) Applicant: Carolyn Marie MacKenzie, Mokena, IL (US)

(72) Inventor: Carolyn Marie MacKenzie, Mokena, IL (US)

( * ) Notice: Subject to any disclaimer, the term of this patent is extended or adjusted under 35 U.S.C. 154(b) by 177 days.

(21) Appl. No.: 16/029,601

(22) Filed: Jul. 8, 2018

(65) Prior Publication Data

US 2020/0008550 A1 Jan. 9, 2020

(51) Int. Cl.

| | |
|---|---|
| ***A45D 8/38*** | (2006.01) |
| ***A45D 8/02*** | (2006.01) |
| ***A45D 8/34*** | (2006.01) |
| ***A45D 8/28*** | (2006.01) |
| ***A45D 8/12*** | (2006.01) |
| ***A45D 8/30*** | (2006.01) |

(52) U.S. Cl.

CPC ..... *A45D 8/38* (2013.01); *A45D 8/02* (2013.01); *A45D 8/12* (2013.01); *A45D 8/28* (2013.01); *A45D 8/30* (2013.01); *A45D 8/34* (2013.01)

(58) Field of Classification Search

CPC ..... A45D 8/00; A45D 8/002; A45D 8/004; A45D 8/10; A45D 8/12; A45D 8/20; A45D 8/22; A45D 8/24; A45D 8/26; A45D 8/28; A45D 8/30; A45D 8/34; A45D 8/38

See application file for complete search history.

(56) References Cited

U.S. PATENT DOCUMENTS

| | | | | | |
|---|---|---|---|---|---|
| 595,926 | A * | 12/1897 | Skillen | A45D 8/00 | 132/275 |
| 757,204 | A * | 4/1904 | Koenig | A45D 8/34 | 132/142 |
| 792,266 | A * | 6/1905 | Hooper | A42B 7/00 | 132/101 |
| 2,649,098 | A * | 8/1953 | Perkins | A45D 8/12 | 132/101 |
| 2,649,763 | A * | 8/1953 | Buergi-Schenk | A45D 8/12 | 132/144 |
| 4,522,215 | A * | 6/1985 | Verducci | A45D 8/12 | 132/219 |
| 5,533,533 | A * | 7/1996 | Shing | A45D 8/12 | 132/276 |
| 5,694,956 | A * | 12/1997 | Grinszpan | A45D 8/12 | 132/273 |
| 5,769,101 | A * | 6/1998 | Iwata | A45D 8/34 | 132/200 |
| 6,267,120 | B1 * | 7/2001 | Serignat | A45D 8/00 | 132/273 |
| 6,581,611 | B2 * | 6/2003 | Sartena | A45D 8/24 | 132/275 |
| 6,959,713 | B2 * | 11/2005 | Silva | A45D 8/34 | 132/200 |
| 7,013,900 | B2 * | 3/2006 | Silva | A45D 8/12 | 132/200 |

(Continued)

*Primary Examiner* — Michael McCullough

(57) ABSTRACT

A volume enhancing hair device is provided comprising a comb element, a coupling joint attached to a first end of the comb element, a clasping mechanism coupled to at least one of the comb element and the coupling joint, and one or more elastic bands coupled to the coupling joint. The volume enhancing hair device is designed to maximize the volume of a user's chosen hair style while having a structurally and functionally simple construction and design.

16 Claims, 2 Drawing Sheets

(56) References Cited

U.S. PATENT DOCUMENTS

| | | | | |
|---|---|---|---|---|
| 8,590,544 | B2 * | 11/2013 | Stewart | A45D 8/12 132/133 |
| 8,678,017 | B2 * | 3/2014 | Arpey | A45D 8/34 132/144 |
| 8,720,452 | B2 * | 5/2014 | Askander | A45D 8/12 132/105 |
| 2003/0168072 | A1 * | 9/2003 | Valdez | A45D 8/00 132/148 |
| 2004/0149305 | A1 * | 8/2004 | Tsai | A45D 8/34 132/273 |
| 2005/0205104 | A1 * | 9/2005 | Silva | A45D 8/08 132/200 |
| 2011/0048441 | A1 * | 3/2011 | Stewart | A45D 8/12 132/200 |
| 2011/0180094 | A1 * | 7/2011 | Greenwald | A45D 8/12 132/210 |

* cited by examiner

VOLUME ENHANCING HAIR DEVICE

BACKGROUND OF THE INVENTION

Hair may be styled into several forms by an individual. Often it is desirous to maximize the volume of the Individual's chosen hair style to project an image of healthy hair. However, the hair of some individuals is not naturally voluminous and generally lays flat regardless of the chosen hair style. It would be advantageous to provide a device that artificially increases the volume of a chosen hair style. It would further be advantageous to provide such a device that achieves this end in a structurally and functionally simple manner.

BRIEF SUMMARY OF THE INVENTION

In some embodiments, a device is provided comprising a comb element; a coupling joint attached to a first end of the comb element; a clasping mechanism coupled to at least one of the comb element and the coupling joint; and one or more elastic bands coupled to the coupling joint.

In some embodiments, the comb element comprises a base disposed at the first end and one or more elongate teeth extending from the base element.

In some embodiments, the coupling joint is rotatably attached to the first end of the comb element and swivels about an axis perpendicular to the first end of the comb element.

In some embodiments, the one or more elastic bands are removably coupled to the coupling joint via an apertured clasp.

In some embodiments, the clasping mechanism is coupled to at least one of the comb element and the coupling joint via at least one of: an elastic coupling, a magnetic coupling, and a hinge.

In some embodiments, the clasping mechanism comprises a clasp attached to a base coupling and the clasp secures hair to the base coupling via at least one of: the elastic coupling, the magnetic coupling, and the hinge.

In some embodiments, the comb element is secured in a position within a head of hair by the clasp attaching to the base coupling.

In some embodiments, the elastic coupling is visibly transparent.

In some embodiments, the clasping mechanism secures hair to the comb element.

In some embodiments, the one or more elastic bands wrap around a first portion of a head of hair to form a pony tail.

In some embodiments, the comb element is secured in a position within a second portion of the head of hair by the clasping mechanism.

In some embodiments, at least one of the first and second portions of the head of hair exhibits a higher level of volume relative the remainder of the head of hair.

In some embodiments, a method is provided comprising wrapping one or more elastic bands around a first portion of a head of hair; inserting a comb element at a position within a second portion of the head of hair; and securing the second portion of the head of hair to the comb element at the position with a clasping mechanism.

In some embodiments, securing the second portion of the head of hair to the comb element at the position with the clasping mechanism comprises coupling a clasp to a base coupling.

In some embodiments, the method comprises securing the first portion of the head of hair via the clasp to the base coupling via at least one of: an elastic coupling, a magnetic coupling, and a hinge.

In some embodiments, the method comprises rotatably attaching a coupling joint to a base of the comb element, and removably coupling the one or more elastic bands to the coupling joint.

In some embodiments, a device is provided comprising a comb element; a coupling joint attached to a first end of the comb element; a clasping mechanism coupled to at least one of the comb element and the coupling joint; and one or more elastic bands coupled to the coupling joint, wherein the one or more elastic bands are wrapped around a first portion of a head of hair, the comb element is inserted at a position within a second portion of the head of hair, and the second portion of the head of hair is secured to the comb element at the position using the clasping mechanism.

DETAILED DESCRIPTION

Figure 1B:
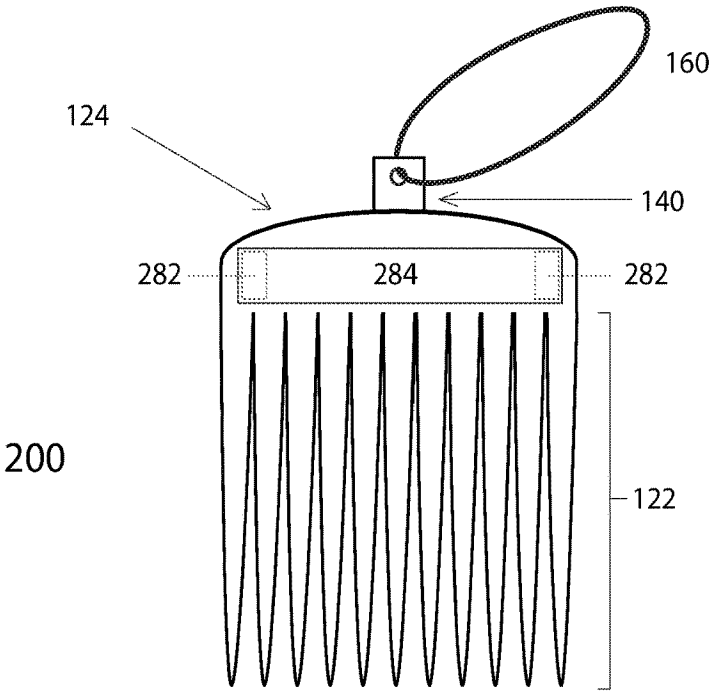
FIGS. 1A and 1B are top views of respective hair devices in accordance with some embodiments of the present invention.

Before describing the present invention in detail, it is to be understood that the invention is not limited to any one of the particular embodiments, which of course may vary. It is also to be understood that the terminology used herein is for the purpose of describing particular embodiments only, and therefore is not necessarily intended to be limiting. As used in this specification and the appended claims, terms in the singular and the singular forms "a," "an," and "the" include plural referents unless the context clearly dictates otherwise. Thus, for example, reference to "a hair device," also includes a plurality of hair devices, and the like.

Exemplary embodiments of the present invention are illustrated in the accompanying figures. As shown in FIG. 1A, a hair device 100 is primarily comprised of a comb element 120, a coupling joint 140, an elastic band 160 and a hair clasp 180. Each of the comb element 120, the coupling joint 140, the elastic band 160 and the hair clasp 180 are operably coupled together.

As shown in FIG. 1A, the comb element 120 comprises a plurality of elongate teeth 122 and a base 124, where the plurality of elongate teeth 122 extend from the base 124. The coupling joint 140 is attached at a first end of the comb element 120 adjacent the base 124. The coupling joint 140 may be permanently or semi-permanently and rotatably coupled to base 124 of comb element 120 via one or more of a rivet, a bearing, an adhesive, male and female fastening joints, snap and release mechanisms and other similar coupling elements. Further, the comb element 120 may take the form of a hair comb, a bridal comb, a banana clip, a jaws clip or other similarly structured comb elements.

Figure 3:
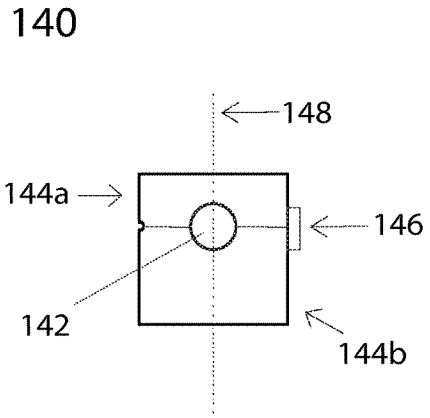
FIG. 3 is a perspective view of a coupling joint of FIGS. 1A and 1B in accordance with some embodiments of the present invention.

As described in further detail in FIG. 3, the elastic band 160 may be secured in an aperture 142 of the coupling joint 140 by a releasable clasp 146 attached to a base 144 of coupling joint 140. Further, a base attachment 182 of the hair clasp 180 may also be secured in the aperture 142 by the releasable clasp 146. In this case, the base attachment 182 may take the form of an elastic coupling that is visibly transparent in order to hide the existence of the attachment 182 in the hair. In this embodiment, the hair clasp 180 is preferably a bobby pin or other similarly structured hair clip.

Figure 1A:
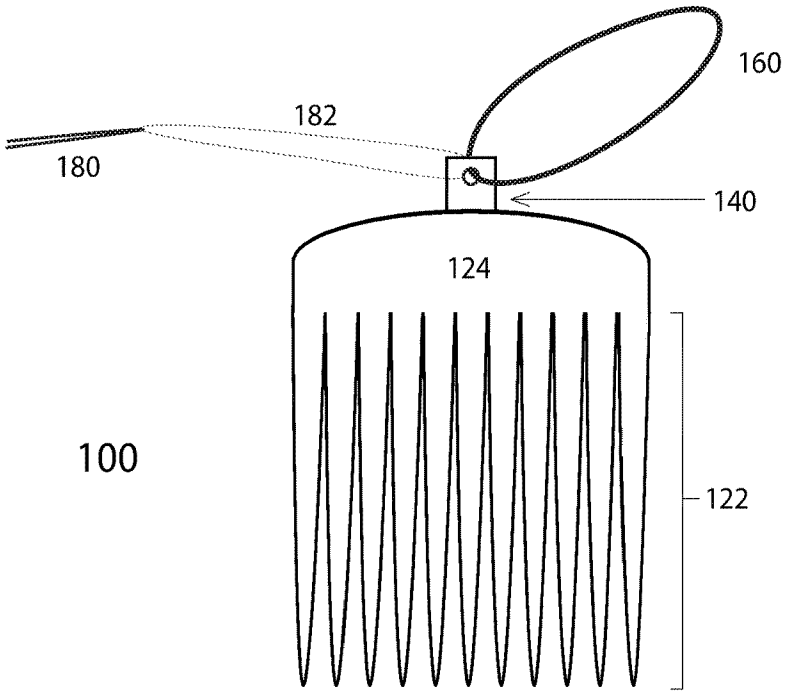

FIG. 1B illustrates a derivative embodiment of the present invention in the form of hair device 200 which comprises modified compatible features from hair device 100 of FIG. 1A. In this embodiment, a hair clasp 280 comprises a base attachment 282 and a releasable clasp 284 which collectively attach directly to the base 124 of the comb element 120. Base attachment 282 may be permanently or semi-permanently coupled to base 124 of comb element 120. Releasable clasp 284 may be releasably coupled to base attachment 282. In some embodiments, releasable clasp 284 may be coupled to base attachment 282 via a magnetic and/or mechanical coupling. In some embodiments, base attachment 282 and releasable clasp 284 may comprise or be compatible with one or more magnets, one or more hinges, hook and loop fasteners, raised c-clips, indented slots and other snap and release configurations that allow for releasable clasp 284 to be releasably coupled to base attachment 282. In some embodiments, releasable clasp 284 may take the form of a magnetically-attractive elongate bar, a bobby pin or other similarly structured hair clip.

Figure 2:
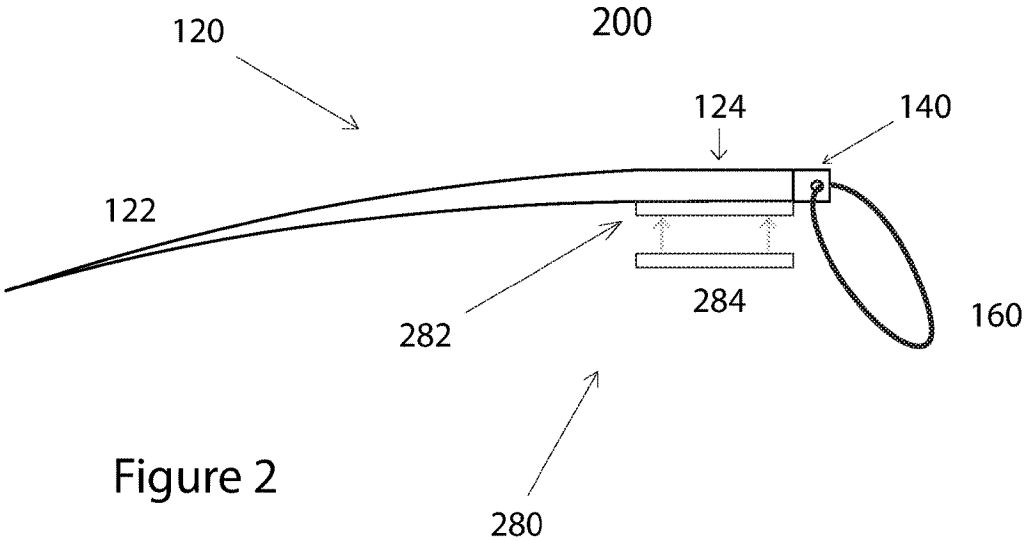
FIG. 2 is a perspective view of a comb element of FIG. 1B in accordance with some embodiments of the present invention.

Hair clasp 280 is shown in FIG. 2 to be directly coupled to the base 124 of the comb element 120. Specifically, base attachment 282 of clasp 280 is shown to be disposed on a bottom side of base 124 and to magnetically couple to a releasable clasp 284. Alternatively, base attachment 282 may be disposed on a top side of base 124 and may couple to releasable clasp 284 in a magnetic and/or mechanical manner using, for example, one or more magnets, one or more hinges, hook and loop fasteners, raised c-clips, indented slots and other similarly structured snap and release configurations.

FIG. 3 depicts the coupling joint 140 of FIGS. 1A-1B & 2 in detail. Similar to FIGS. 1A-1B & 2, the coupling joint 140 comprises the aperture 142, base 144 and releasable clasp 146. The base 144 further comprises upper base portion 144*a* and lower base portion 144*b* and may be constructed to rotate about an axis 148 to allow for elastic band 160 to be oriented in any manner without twisting of the band 160 itself. Releasable clasp 146 releasably secures upper and lower base portions 144*a*, 144*b* together to maintain the elastic band 160 within the aperture 142 of the coupling joint 140. Further, releasable clasp 146 may be unclasped to allow separation of upper base portion 144*a* from lower base portion 144*b* in the event it is desired to insert or replace the elastic band 160. Separation of upper base portion 144*a* from lower base portion 144*b* may be achieved in a hinged manner where the hinge coupled the base portions together at an end opposite that of releasable clasp 146. Alternatively, multiple releasable clasps 146 may be utilized at opposite sides of the coupling surface of upper and lower base portions 144*a*, 144*b* to secure and separate the base portions. In other embodiments, coupling joint 140 may utilize other forms of snap and release or clasp and release coupling arrangements to selectively couple the elastic band 160 within the aperture 142.

Figure 4:
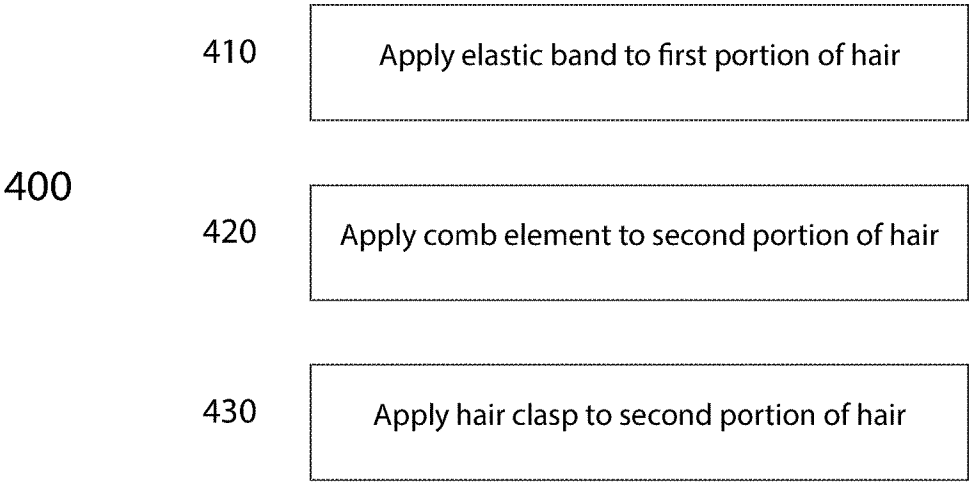
FIG. 4 is a flow diagram of a method of using the hair device of FIGS. 1A and 1B.

FIG. 4 illustrates a flow diagram of process 400 for using the hair devices 100, 200 of FIGS. 1A-1B & 2, respectively. In step 410, a user of the hair device wraps the elastic band 160 around a first portion of hair which forms a first hair style. The first hair style may be a pony tail, a braid or other similarly formed style. In step 420, the user places the comb element 120 in a second portion of hair. Comb element 120 is inserted in the second portion of hair such that the elongate teeth 122 comprise the second portion of hair therebetween.

In step 430, the user secures hair to the base 124 of the comb element 120 using a hair clasp. In the embodiment of FIG. 1A, the hair clasp 180 itself secures hair to the base 124 and is coupled to the coupling joint 140 via the base attachment 182. In the embodiment of FIG. 1B, step 430 involves the user securing hair to the base 124 using hair clasp 280. Hair clasp 280 utilizes the releasable clasp 284 to secure hair to the base 124 and is coupled to the comb element 120 via base attachment 282 which may comprise or be compatible with one or more magnets, one or more hinges, hook and loop fasteners, raised c-dips, indented slots and other snap and release configurations.

One object of process 400 is to increase the visual volume of the second portion of hair. Another object of process 400 is to increase the vertical orientation of the first portion of hair so that it is closer in alignment with a vertical axis of the user. Increasing the visual volume of the second portion of hair and the vertical orientation of the first portion of hair gives the perception that the user's hair strands are thicker, that the follicles are more densely populated and that the user more generally has a healthier head of hair.

It is further contemplated that the user of the hair device and process of using the hair device of the present invention could be an end consumer or a hair stylist styling the hair of the end consumer. When the hair device is being used by the end consumer, the object of end consumer use may be to increase the volume of the end consumer's chosen hair style. When the hair device is being used by the hair stylist, the object of hair stylist use may be to maintain end consumer's hair at a desired level of volume in order to execute a desired hair styling upon the end consumer's hair.

It is further contemplated that the hair device of some embodiments may comprise multiple comb elements, coupling joints, elastic bands and hair clasps along with the respective associated subcomponents described above. The comb element may comprise a plurality of gripping structures thereon which are shaped to grip strands of hair and may generally take the form of a hook shape to achieve that end. In some examples, gripping structures may take the form of hook and loop fasteners for hair or other similarly structured hook-shaped elements for gripping strands of hair.

It is further contemplated that the comb element, the coupling joint and the hair clasp may be formed as a unitary structure or as discrete elements. Further, the comb element, the coupling joint and the hair clasp may be formed of a rigid material such as one or more of metals or polymeric materials. In some embodiments, the elastic band and base attachment may be formed of elastomeric materials.

While the foregoing invention has been described in some detail for purposes of clarity and understanding, it will be clear to one skilled in the art from a reading of this disclosure that various changes in form and detail can be made without departing from the true scope of the invention. For example, all the techniques and apparatuses described in the above embodiments may be used in various combinations.

The invention claimed is:

1. A device, comprising:

a comb element comprising a base and at least five elongate teeth extending from the base in a first plane, wherein each of the at least five elongate teeth are arranged parallel relative one another;

a coupling joint attached to the base of the comb element, wherein the coupling joint extends from the base in a direction parallel to the first plane and rotates about an axis parallel to the first plane, wherein the coupling joint comprises a top portion disposed adjacent a bottom portion along a second plane orthogonal to the first plane, wherein the bottom portion comprises a first semicircular groove which terminates along the second plane and the top portion comprises a second semicircular groove which terminates along the second plane, and wherein the top portion and the bottom portion are coupled to one another along a hinge;

a hairpin coupled within an indented slot of the base of the comb element; and one or more elastic bands contained within the first and second semicircular grooves of the coupling joint.

2. The device of claim 1, wherein the one or more elastic bands are removable from the coupling joint and reinsertable into the coupling joint.

3. The device of claim 2, wherein the one or more elastic bands are removable from the coupling joint and reinsertable into the coupling joint via an apertured clasp disposed on an exterior surface of the coupling joint that is opposite the exterior surface comprising the hinge.

4. The device of claim 1, wherein the hairpin is further retained within the indented slot of the base of the comb element via at least one of: an elastic coupling, a magnetic coupling, a hinge, and a snap.

5. The device of claim 4, wherein the hairpin comprises a clasp iteratively removable and attachable to a base coupling.

6. The device of claim 5, wherein the clasp secures hair to the base coupling via at least one of: the elastic coupling, the magnetic coupling, the hinge, and the snap.

7. The device of claim 5, wherein the comb element is secured in a position within a head of hair by the clasp attaching to the base coupling.

8. The device of claim 4, wherein the elastic coupling is visibly transparent.

9. The device of claim 1, wherein the hairpin secures hair to the comb element.

10. The device of claim 1, wherein the one or more elastic bands wrap around a first portion of a head of hair to form a pony tail.

11. The device of claim 10, wherein the comb element is secured in a position within a second portion of the head of hair by the hairpin.

12. The device of claim 11, wherein at least one of the first and second portions of the head of hair exhibits a higher level of volume relative the remainder of the head of hair.

13. A method, comprising:

wrapping one or more elastic bands around a first portion of a head of hair;

inserting a comb element at a position within a second portion of the head of hair, wherein the comb element comprises a base and at least five elongate teeth extending from the base in a first plane, wherein each of the at least five elongate teeth are arranged parallel relative one another;

rotatably attaching a coupling joint to a base of the comb element, wherein the coupling joint extends from the base in a direction parallel to the first plane and rotates about an axis parallel to the first plane, wherein the coupling joint comprises a top portion disposed adjacent a bottom portion along a second plane orthogonal to the first plane, wherein the bottom portion comprises a first semicircular groove which terminates along the second plane and the top portion comprises a second semicircular groove which terminates along the second plane, wherein the top portion and the bottom portion are coupled to one another along a hinge, and wherein the hinge allows the one or more elastic bands to be removable from the first and second semicircular grooves and securable within the first and second semicircular grooves; and securing the second portion of the head of hair to the comb element at the position with a hairpin, wherein the hairpin is stored within an indented slot of the base of the comb element.

14. The method of claim 13, wherein securing the second portion of the head of hair to the comb element at the position with the hairpin comprises coupling a clasp to a base coupling.

15. The method of claim 14, further comprising securing the first portion of the head of hair via the clasp to the base coupling via at least one of: an elastic coupling, a magnetic coupling, a hinge, and a snap.

16. A device, comprising:

a comb element comprising a base and at least five elongate teeth extending from the base in a first plane, wherein each of the at least five elongate teeth are arranged parallel relative one another;

a coupling joint attached to the base of the comb element, wherein the coupling joint extends from the base in a direction parallel to the first plane and rotates about an axis parallel to the first plane, wherein the coupling joint comprises a top portion disposed adjacent a bottom portion along a second plane orthogonal to the first plane, wherein the bottom portion comprises a first semicircular groove which terminates along the second plane and the top portion comprises a second semicircular groove which terminates along the second plane, and wherein the top portion and the bottom portion are coupled to one another along a hinge;

a hairpin coupled within an indented slot of the base of the comb element, wherein the hairpin is retained within the indented slot via magnetic engagement with a plurality of magnetically susceptible walls of the indented slot; and one or more elastic bands coupled to the coupling joint, wherein the hinge allows the one or more elastic bands to be removable from the first and second semicircular grooves and securable within the first and second semicircular grooves, and wherein the one or more elastic bands are wrapped around a first portion of a head of hair, the comb element is inserted at a position within a second portion of the head of hair, and the second portion of the head of hair is secured to the comb element at the position using the hairpin.

* * * * *